US006877605B2

(12) United States Patent
Tsai

(10) Patent No.: US 6,877,605 B2
(45) Date of Patent: Apr. 12, 2005

(54) SIDE MOUNT DEVICE FOR MULTIPLE FOLDABLE FURNITURE PACKAGING AND DISPLAYING

(75) Inventor: Frank Tsai, ShenZhen (CN)

(73) Assignee: Wok & Pan Industry, Inc., Shenzhen (CN)

( * ) Notice: Subject to any disclaimer, the term of this patent is extended or adjusted under 35 U.S.C. 154(b) by 195 days.

(21) Appl. No.: 10/270,382

(22) Filed: Oct. 15, 2002

(65) Prior Publication Data

US 2004/0069665 A1 Apr. 15, 2004

(51) Int. Cl.[7] ..... B65D 85/00
(52) U.S. Cl. ..... 206/326; 206/523
(58) Field of Search ..... 206/326, 320, 206/325, 445, 448, 453, 516, 523, 586, 587, 593, 814, 591, 592; 248/188.9; 211/27; D9/456; D8/354, 380

(56) References Cited

U.S. PATENT DOCUMENTS 3,221,973 A * 12/1965 Kalbrener ..... 206/600
3,344,916 A * 10/1967 Brueckner ..... 206/453
3,946,868 A * 3/1976 Rutter ..... 206/455
4,513,864 A * 4/1985 Liebel ..... 206/396
5,439,730 A * 8/1995 Kelly et al. ..... 428/156
5,887,718 A * 3/1999 Oslin et al. ..... 206/499

FOREIGN PATENT DOCUMENTS

WO WO 9429196 A1 * 12/1994 ..... B65D/85/66

* cited by examiner

*Primary Examiner*—Mickey Yu
*Assistant Examiner*—J. Gregory Pickett
(74) *Attorney, Agent, or Firm*—Raymond Y. Chan; David and Raymond

(57) ABSTRACT

A side mount device, which is adapted for mounting on multiple foldable furniture each having a side rim portion, includes an elongated mold strip including a first reinforcing panel and a second reinforcing panel longitudinally extended therefrom to define a longitudinal mounting channel therebetween. The first reinforcing panel has a longitudinal guider edge, a plurality of mounting slots spacedly and transversally extended from the longitudinal guider edge for slidably receiving the side rim portions of the foldable furniture into the mounting channel so as to spacedly hold the foldable furniture in position, and a plurality of retaining arms which are extended from upper ends of the mounting slots respectively and arranged for pressing on the side rim portions of the foldable furniture when the side rim portions of the foldable furniture are slid through the mounting slots respectively.

13 Claims, 9 Drawing Sheets

SIDE MOUNT DEVICE FOR MULTIPLE FOLDABLE FURNITURE PACKAGING AND DISPLAYING

BACKGROUND OF THE INVENTION

1. Field of Invention

The present invention relates to a foldable furniture, and more particularly to a side mount device for multiple foldable furniture, which can well pack and display the foldable furniture while being space effective.

2. Description of Related Arts

A conventional foldable furniture, such as a foldable chair or a foldable table has become very popular since the foldable furniture is economy and cheap, and can be quickly and easily folded for carriage and storage and unfolded for use. Especially when some participant-intensive activities take place in multi-function rooms or designated areas, the foldable furniture can be temporary set up in minutes. After the functions, the foldable furniture can be quickly folded up for storage.

Such conventional foldable furniture comprises a supporting panel and a leg frame pivotally connected thereto wherein the foldable furniture is capable being folded between a set-up position and a folded position. For example, the foldable table is capable of folding the leg frame underneath the tabletop (the supporting panel) or the foldable chair is capable of pivotally folding the leg frame with respect to the seat frame (the supporting panel). The common feature of such conventional foldable furniture is that when the foldable furniture is folded up, the size of the foldable furniture is reduced for easily carriage and storage.

However, it is a headache for the user to pack a plurality of foldable furniture. For example, the foldable tables must be overlappedly stacked up together such that the foldable tables will be easily cracked by their own weights. Moreover, the foldable chairs must be lined up with each other for packaging. Therefore, while transporting the foldable chairs, not only a few foldable chairs are packed together for easily transportation but also the foldable chairs will be easily scratched by the adjacent foldable chairs.

In addition, the major drawback of the foldable furniture is that when they are well packed, the user must take the foldable furniture at the outermost position. In other words, the foldable furniture at the mid-position of the packaging is impossible to be taken out because the whole stack of the foldable furniture may be collapsed, which may cause a serious injury to the user.

SUMMARY OF THE PRESENT INVENTION

A main object of the present invention is to provide a side mount device for multiple foldable furniture, which can well pack and display the foldable furniture while being space effective.

Another object of the present invention is to provide a side mount device for multiple foldable furniture, wherein the side mount device provides a plurality of spaced apart holding slots for spacedly retaining the foldable furniture in position in such a manner that the foldable furniture are spacedly divided by the side mount device so as to prevent the foldable furniture from being collided with each other.

Another object of the present invention is to provide a side mount device for multiple foldable furniture, wherein the foldable furniture are individually held by the side mount device such that even though the foldable furniture at the mid-position of the packaging is taken out, the rest of the foldable furniture will be held in the stable manner. In other words, the side mount device can be used for holding the foldable furniture for a display purpose so that the user is able to select which foldable furniture in the package that he or she wants to purchase without collapsing the whole stack of the foldable furniture.

Another object of the present invention is to provide a side mount device for multiple foldable furniture, wherein a large quantity of the foldable furniture can be well packed by the side mount device without damaging the foldable furniture, so as to substantially reduce the shipping and handling costs of the foldable furniture for the manufacturer.

Another object of the present invention is to provide a side mount device for multiple foldable furniture, wherein no expensive or complicated structure is required to employ in the present invention in order to achieve the above mentioned objects. Therefore, the present invention successfully provides an economic and efficient solution for providing a reinforced side mount configuration to retain the foldable furniture in packaging and displaying purpose.

Accordingly, in order to accomplish the above objects, the present invention provides a side mount device for mounting on multiple foldable furniture each having a side rim portion, comprising at least an elongated mold strip comprising a first reinforcing panel and a second reinforcing panel longitudinally extended from the first reinforcing panel along a common line-edge to define a longitudinal mounting channel therebetween.

The first reinforcing panel has a longitudinal guider edge, a plurality of mounting slots spacedly and transversally extended from the longitudinal guider edge towards the common line-edge for slidably receiving the side rim portions of the foldable furniture into the mounting channel through the mounting slots respectively while the second reinforcing panel retains the side rim portions of the foldable furniture within the mounting channel so as to spacedly hold the foldable furniture in position, and a plurality of retaining arms which are extended from upper ends of the mounting slots respectively and arranged for pressing on the side rim portions of the foldable furniture when the side rim portions of the foldable furniture are slid through the mounting slots respectively.

DETAILED DESCRIPTION OF THE PREFERRED EMBODIMENT

Figure 1:
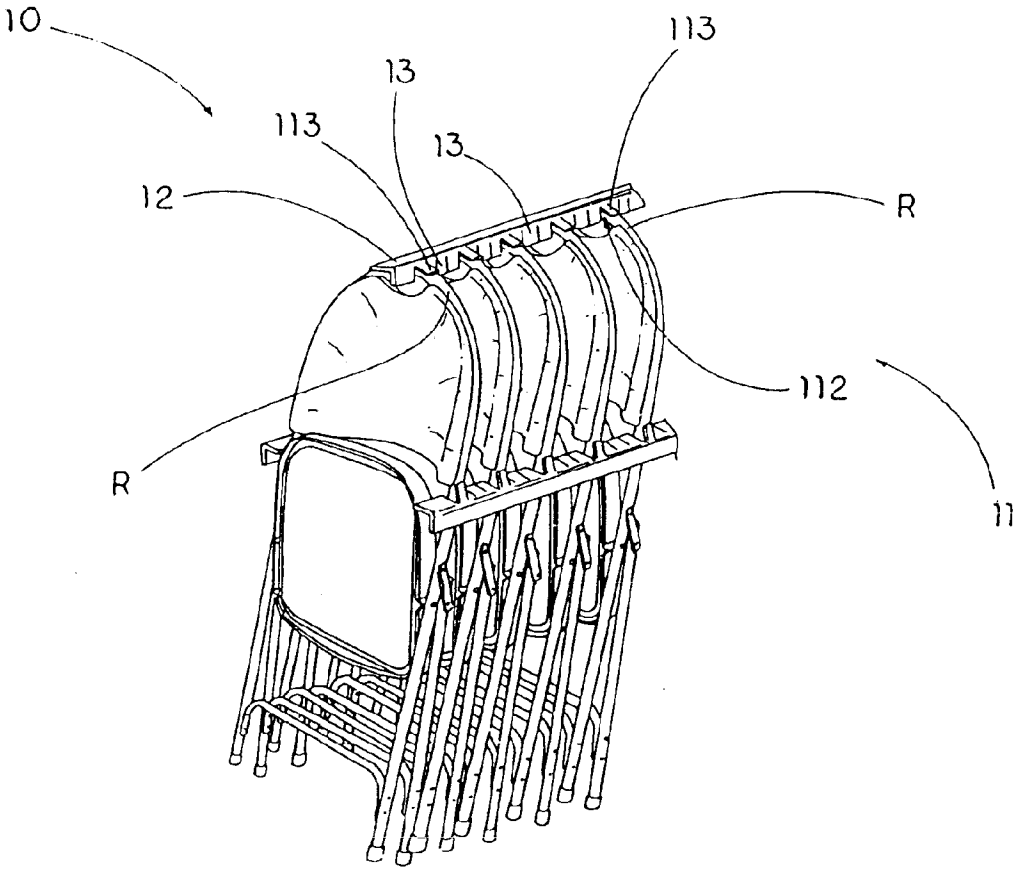
FIG. 1 is a perspective view of a side mount device mounted on the foldable furniture according to a preferred embodiment of the present invention.
Figure 2:
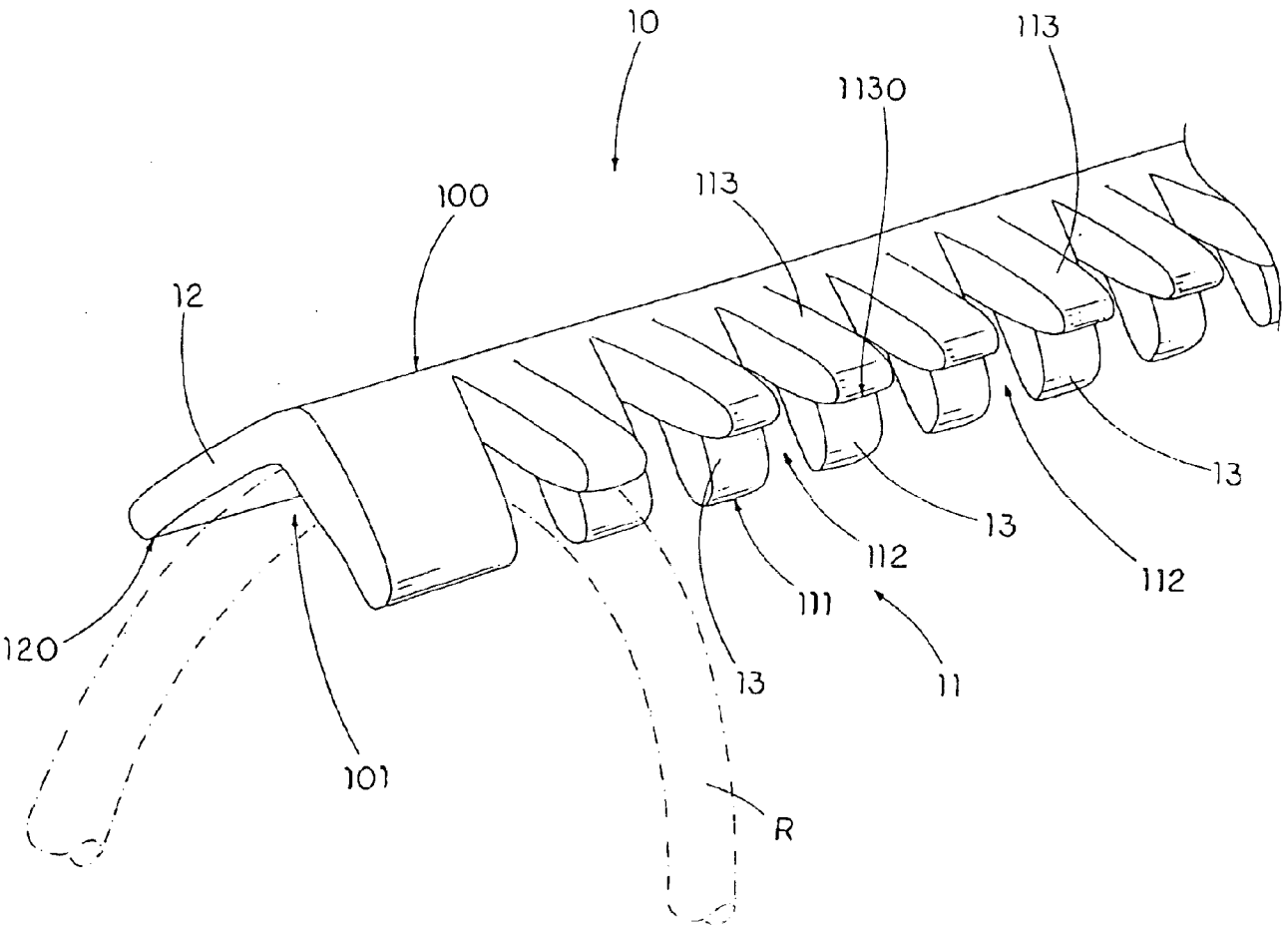
FIG. 2 is a perspective view of the side mount device for multiple foldable furniture according to the above preferred embodiment of the present invention.

Referring to FIGS. 1 and 2 of the drawings, a side mount device according to a preferred embodiment of the present invention is illustrated, wherein the side mount device is capable of substantially holding a plurality of foldable furniture for packaging and displaying purpose. Accordingly, each of the foldable furniture has a side rim R extending along two side edges and a top edge thereof.

As shown in FIG. 2, the side mount device comprises an elongated mold strip 10 comprising a first reinforcing panel 11 and a second reinforcing panel 12 longitudinally extended from the first reinforcing panel 11 along a common line-edge 100 to define a longitudinal mounting channel 101 therebetween.

The first reinforcing panel 11 has a longitudinal guider edge 111, a plurality of mounting slots 112 spacedly and transversally extended from the longitudinal guider edge 111 towards the common line-edge 100 for slidably receiving predetermined side rim portions R of the foldable furniture into the mounting channel 101 through the mounting slots 112 respectively while the second reinforcing panel 12 retains the side rim portions R of the foldable furniture within the mounting channel 101 so as to spacedly hold the foldable furniture in position, and a plurality of retaining arms 113 which are extended from upper ends of the mounting slots 112 respectively and arranged for pressing on the side rims R of the foldable furniture when the side rim portions R of the foldable furniture are slid through the mounting slots 112 respectively.

According to the preferred embodiment, the mold strip 10 is preferably made of rigid material such as cardboard or plastic, which can simply be manufactured in low cost. The mold strip 10, having a L-shaped cross sectional, defines the common line-edge 100 where the first and second reinforcing panels 11, 12 longitudinally and integrally meet with each other wherein the mounting channel 101 is longitudinally formed between two inner sides of the first and second reinforcing panels 11, 12.

The mounting slots 112 are spacedly formed along the first reinforcing panel 11 between two end portions thereof wherein each of the mounting slots 112 has a uniform thickness larger than a width of the side rim R of each foldable furniture in such a manner that when the corresponding side rim portion R of the foldable furniture is slid to the mounting slot 112, the side rim R of the foldable furniture is retained by two side edges of the mounting slot 112, so as to substantially hold the foldable furniture in position.

Moreover, the first reinforcing panel 11 is made of elastic material to form each of the retaining arms 113 as a resilient arm for applying an urging pressure on the respective side rim portion R of the foldable furniture when the mold strip 10 is mounted on the foldable furniture. In other words, when the side rim portion R of the foldable furniture is slid to the mounting slot 112, the respective retaining arm 113 is substantially pressed on the side rim portion R of the foldable furniture by means of resilient properties of the retaining arm 113, so as to lock up the foldable furniture within the mounting channel 101 in position.

The mold strip 10 further comprises a plurality of space dividers 13 transversely extended from the first reinforcing panel 11 between each two mounting slots 112 wherein each of the space dividers 13 is arranged in such a manner that when the side rim portions R of the foldable furniture are received in the mounting channel 101 through the mounting slot 112 respectively, each of the space dividers 13 is positioned between each two foldable furniture to create a safety gap therebetween, so as to prevent the foldable furniture from contacting with each other.

Accordingly, the mold strip 10 is made by providing a plurality of parallel cuts spacedly and transversely on the first reinforcing panel 11 extended from the longitudinal guider edge 111 to form a plurality of folding lips each defining between two parallel cuts, wherein each of the retaining arms 113 is formed by outwardly folding one of the folding lips and each of the space dividers 13 is formed by unfolding one of the folding lips, so as to form the mounting slots 112 with respect to the retaining arms 113. In other words, the retaining arms 113 are integrally extended from the first reinforcing panel 11 at the upper ends of the mounting slots 112 respectively.

Therefore, the mold strip 10 can be made as a universal molding reinforcement for packing different sizes of the foldable furniture. While packing the foldable chairs which have relatively smaller size of the side rim R, one of the folding lips can be folded outwardly to form the reinforcing arm 113 and the mounting slot 112 while the adjacent folding lip is remained unfold to form the space divider 13. Likewise, while packing the foldable tables which have relative larger size of the size rim R, i.e. the side edge of the tabletop, two adjacent folding lips are folded outwardly to form the reinforcing arm 113 with a larger width of the mounting slot 112, while two adjacent folding lips are remained unfolded to form the space divider 13. In other words, the user is able to select the width of the mounting slot 112 to fit the side rim R of the foldable furniture and the width of the space divider 13 to create the safety gap between each two foldable furniture.

Figure 3:
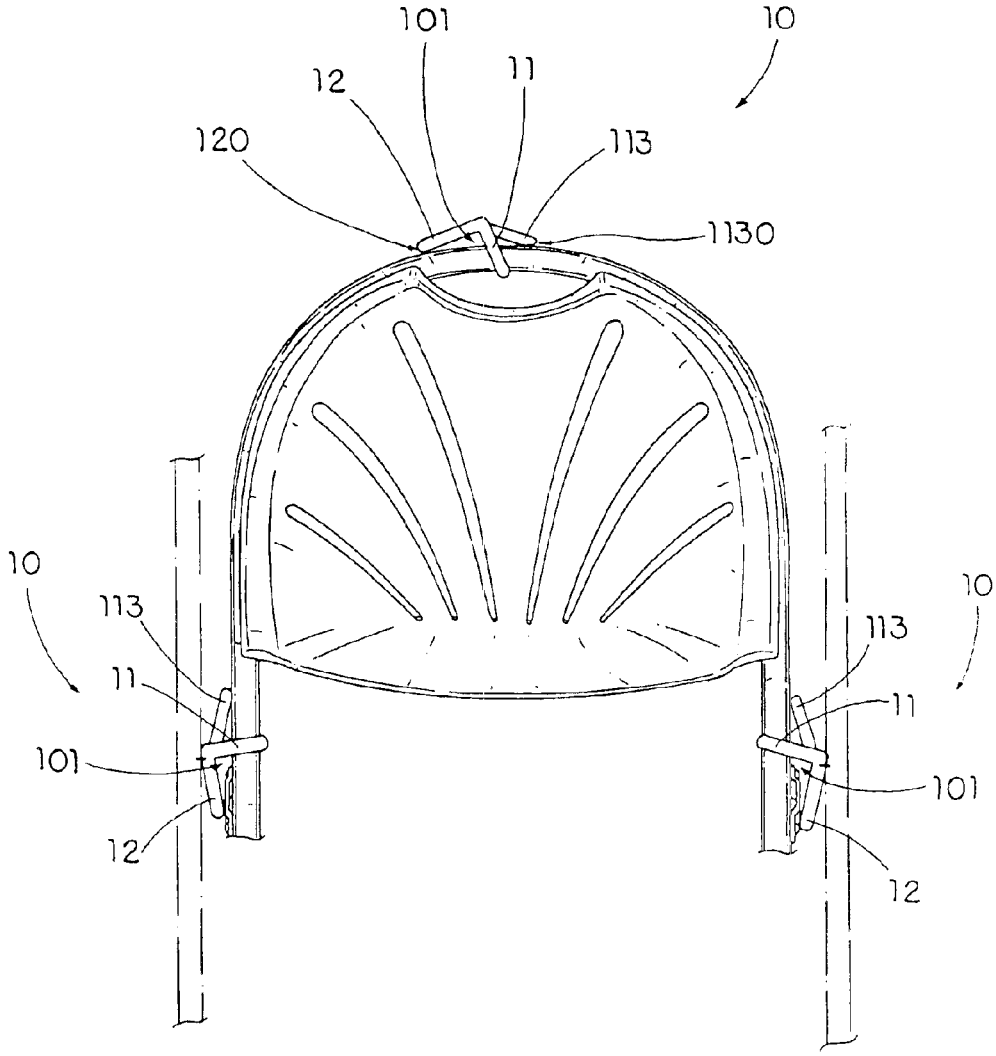
FIG. 3 is a sectional view of the side mount device mounted on the foldable furniture according to the above preferred embodiment of the present invention.

As shown in FIG. 3, when the mold strip 10 is mounted on the foldable furniture, the side rims R of the foldable furniture are locked within the mounting slots 112 so as to prevent an unwanted longitudinal movement of the foldable furniture with respect to the mold strip 10. In addition, a longitudinal bottom edge 120 of the second reinforcing panel 12 and longitudinal retaining edges 1130 of the retaining arms 113 are respectively biased against the side rims R of the foldable furniture to substantially hold the side rim portions R of the foldable furniture within the mounting channel 101 of the mold strip 10, so as to prevent an unwanted transversal movement of the foldable furniture with respect to the mold strip 10.

Preferably, three mold strips 10 are used for substantially packing the foldable furniture in a parallelly line-up manner, as shown in FIG. 1, wherein one of the mold strips 10 is mounted on top of the foldable furniture while the other two of the mold strips 10 are mounted at two sides of the foldable furniture so as to pack the foldable furniture in an overlapped manner. It is worth mentioning that when the foldable furniture are packed, there is no contact between the foldable furniture so as to prevent any scratch on the foldable furniture during transporting the whole pack of the foldable furniture.

Figure 4:
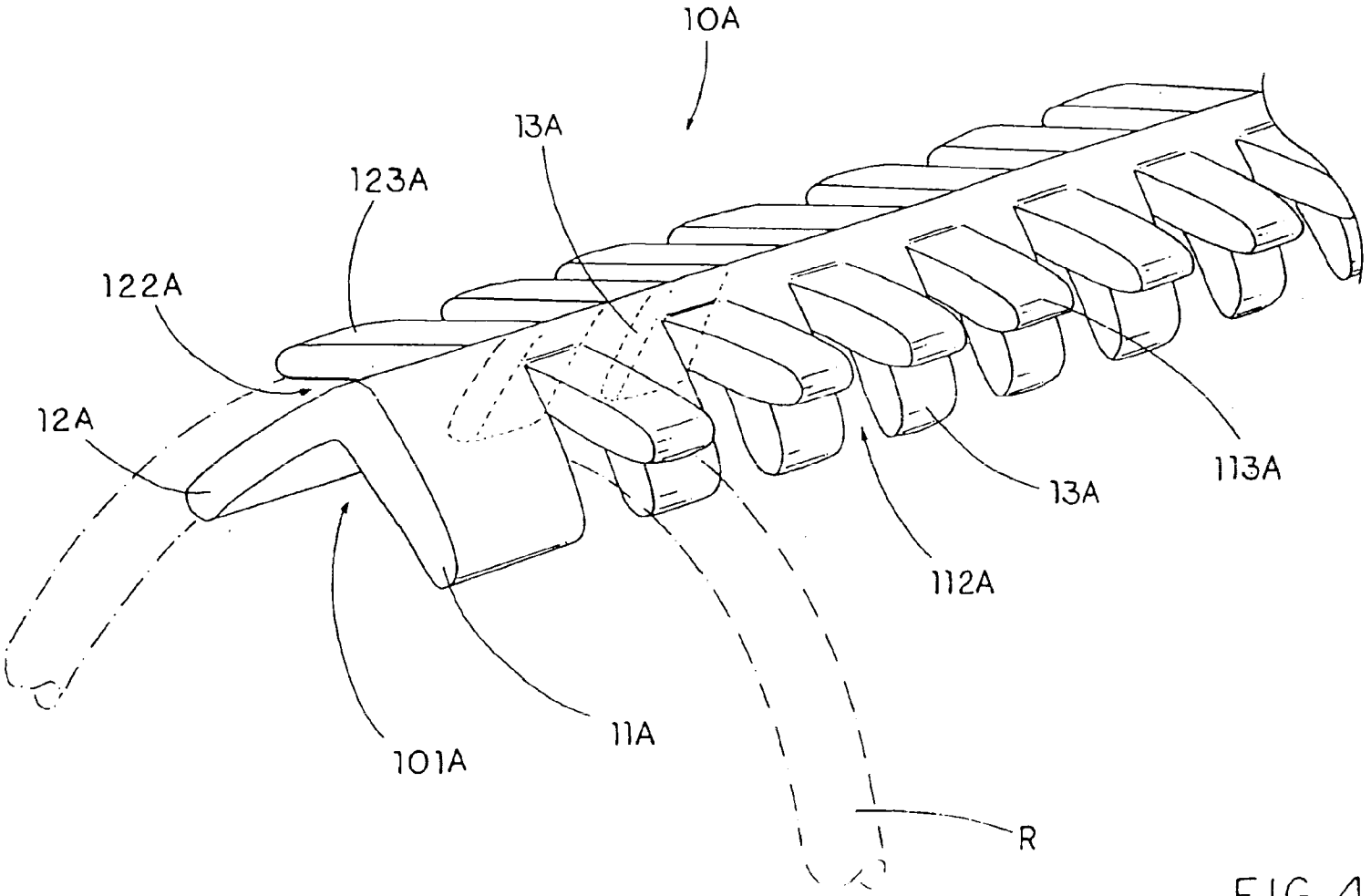
FIG. 4 illustrates a first alternative mode of the side mount device according to the above preferred embodiment of the present invention.

FIG. 4 illustrates a first alternative mode of the mold strip 10A wherein the second reinforcing panel 12A, which is constructed to be identical to the first reinforcing panel 11A, comprises the mounting slots 122A, the reinforcing arms 123A and the space dividers 13A, wherein the mounting slots 122A of the second reinforcing panel 12A are aligned with the mounting slots 112A of the first reinforcing panel 11A.

When the mold strip 10A is mounted on the foldable furniture, the side rim portion R of the foldable furniture is slidably received in the mounting channel 101A through the two mounting slots 112A, 122A of the first and second reinforcing panels 11A, 12A respectively, so as to lock up the transversely movement of the foldable furniture. Moreover, the retaining arms 113A, 123A of the first and second reinforcing panels 11A, 12A are substantially biased against the side rim portion R of the foldable furniture so as to well pack the foldable furniture with safety gap therebetween.

Figure 5:
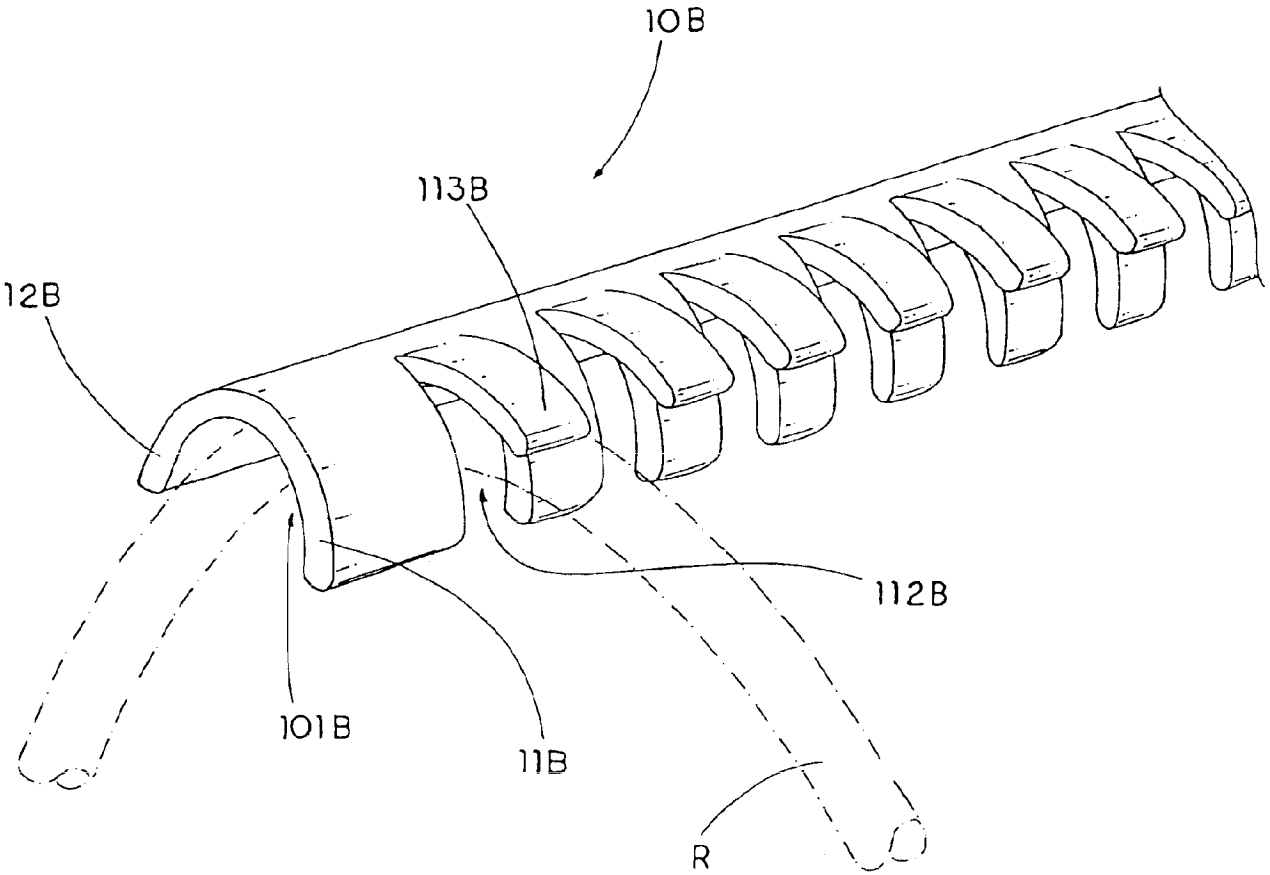
FIG. 5 illustrates a second alternative mode of the side mount device according to the above preferred embodiment of the present invention.

FIG. 5 illustrates a second alternative mode of the mold strip 10B having an arc-shaped cross sectional wherein the first and second reinforcing panels 11B, 12B are constructed to have an arc-shape and integrally extended together to provide the mounting channel 101B having a curved top surface. Such mold strip 10B is specifically designed for the foldable furniture having a curved side rim portion R, such as the foldable chair, so as to fittedly mount the mold strip 10B on the side rim portion R of the foldable furniture at an upper section thereof within the mounting slot 112B while the retaining arm 113B is pressed on the side rim portion R of the foldable furniture.

Figure 6:
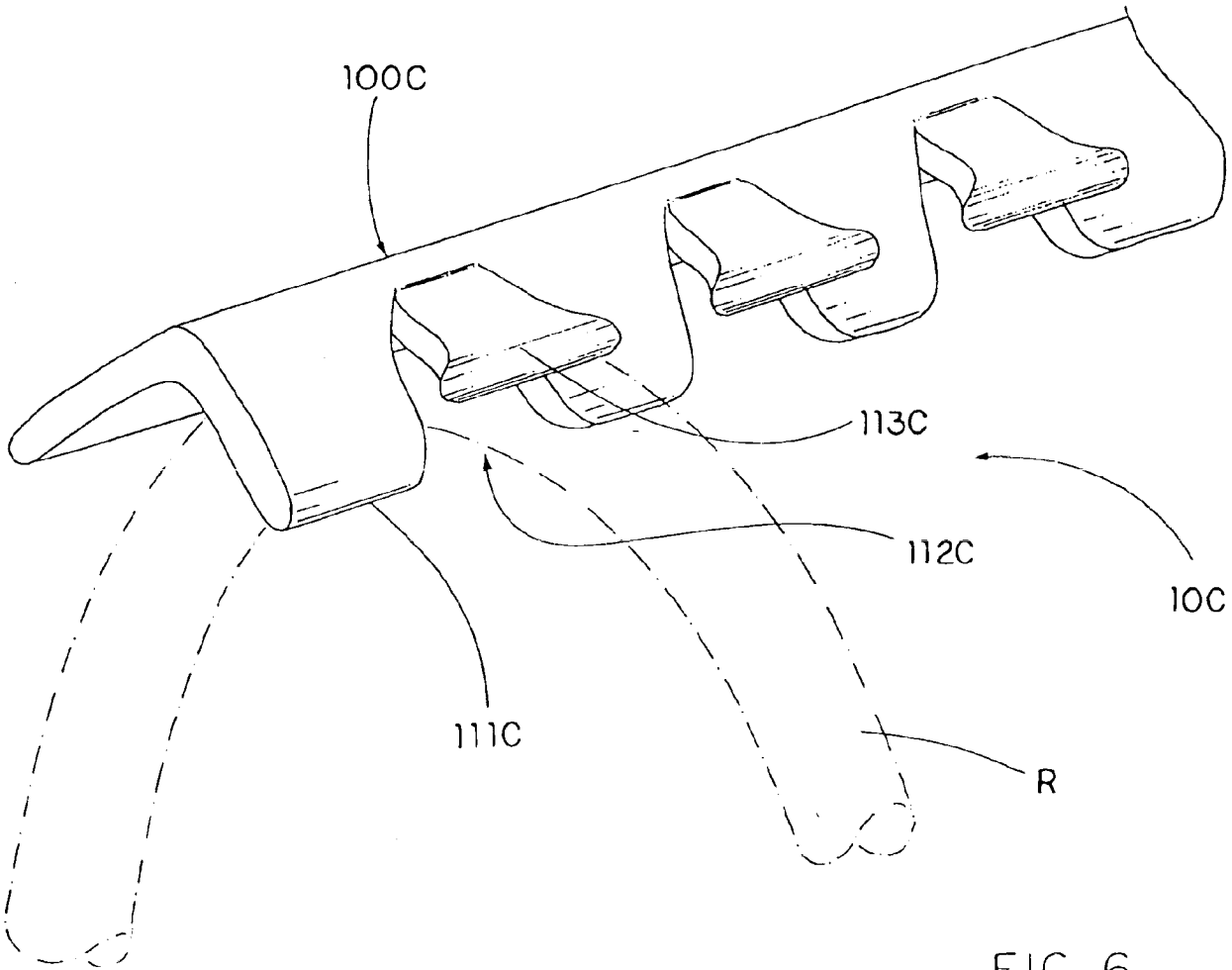
FIG. 6 illustrates a third alternative mode of the side mount device according to the above preferred embodiment of the present invention.

FIG. 6 illustrates a third alternative mode of the mold strip 10C wherein each of 10 the molding slots 112C has a width gradually reducing from the guider edge 111C towards the common line-edge 110C in such a manner that any size of the side rim R of the foldable furniture can be fit to slide to the mounting slot 112C and locked up by two side edges of the mounting slot 112C. In addition, a width of the retaining arm 113C is lengthened to increase the contacting area of the retaining arm 113C pressing on the side rim portion R of the foldable furniture.

Figure 7:
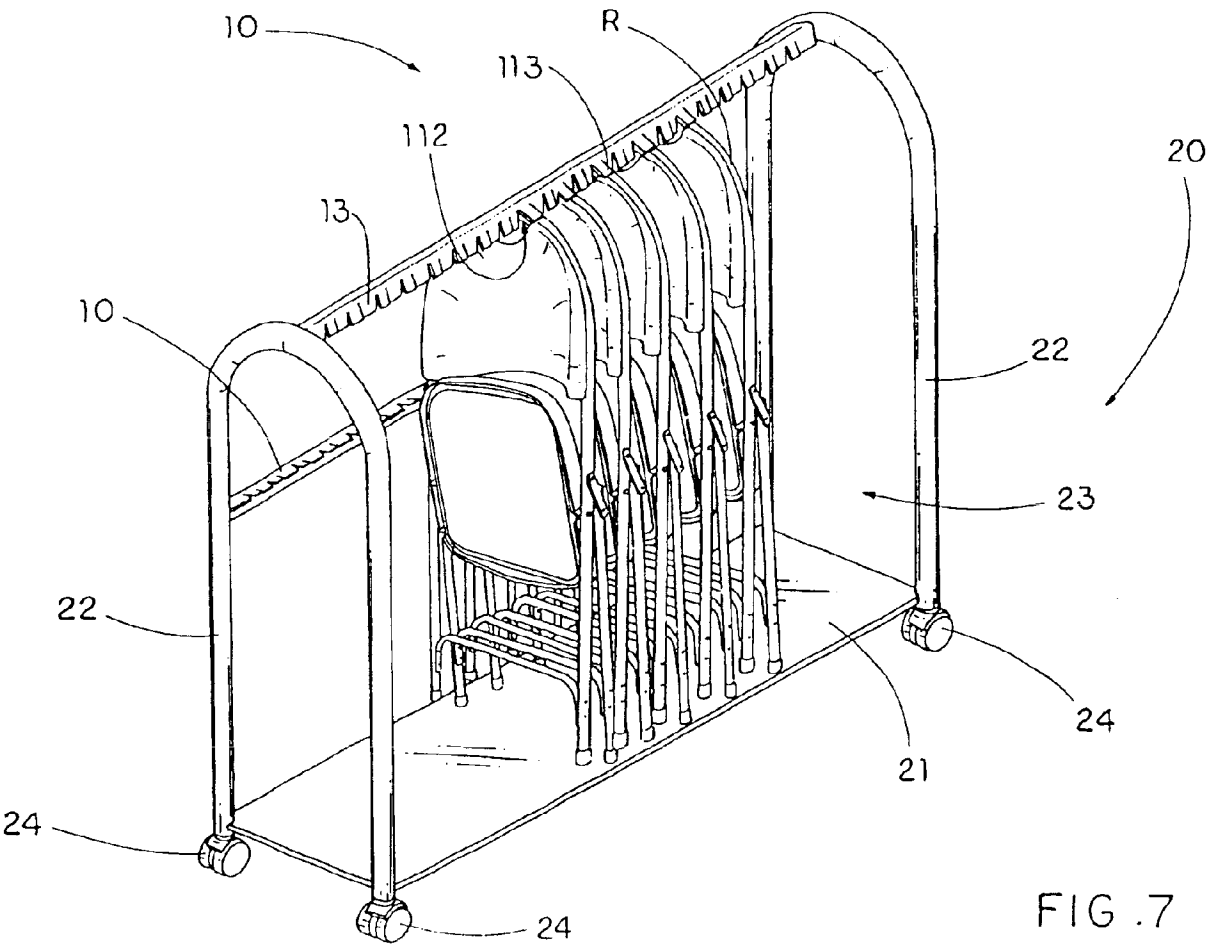
FIG. 7 is a perspective view of the side mount device incorporated with a supporting frame according to the above preferred embodiment of the present invention.

As shown in FIG. 7, the side mount device further comprises a supporting frame 20 comprising a base frame 21 and two side standing frames 22 mounted at two sides of the base frame 21 respectively to form a storage compartment 23 between the side standing frames 22 and the base frame 21 for receiving the foldable furniture in an overlappedly line-up manner, wherein two end portions of the mold strip 10 are mounted to two top portions of the side standing frames 22 respectively for securely locking the side rim portions R of the foldable furniture so as to securely retain the foldable furniture in the storage compartment 23.

Accordingly, the supporting frame 20 is specifically designed for the foldable chairs, as shown in FIG. 7, wherein the foldable chairs are stocked into the storage compartment 23 in a line up manner while a bottom portion of each foldable chair is supported by the base frame 21 and a top portion of each foldable chair, i.e. the side rim portion R, is slid into the respective mounting slot 112 for well packing up the foldable chairs.

Preferably, another mold strip 10 is mounted between two mid-portions of the side standing frames 22 at one side thereof, such that one side portion and the top portion of each foldable chair is retained by the two mold strips 10 respective so as to further ensure the foldable chairs are substantially locked up within the storage compartment 23 of the supporting frame 20.

Furthermore, there are four wheels 24 rotatably mounted at four bottom ends of the side standing frames 22 respectively, in such a manner that when the foldable chairs are stored in the supporting frame 20, the user is able to transport the well packed foldable chairs from one place to another place. For example, when a participant-intensive activity takes place in a function room of a restaurant or a hotel, the employees are able to carry the whole stack of foldable chairs in the supporting frame 20 from the storage room to the function room. After the activity is finished, the employees are able to slide the foldable chairs back into the supporting frame 20 one by one and to lock the foldable chairs via the mold strip 10, so as to transport the supporting frame 20 back to the storage room.

It is worth mentioning that the alternative modes of the mold strips 10A, 10B, 10C can be incorporated with the supporting frame 20 in order to enhance the secure mounting feature of the side mount device for retaining the foldable furniture in the storage compartment 23.

Figure 8:
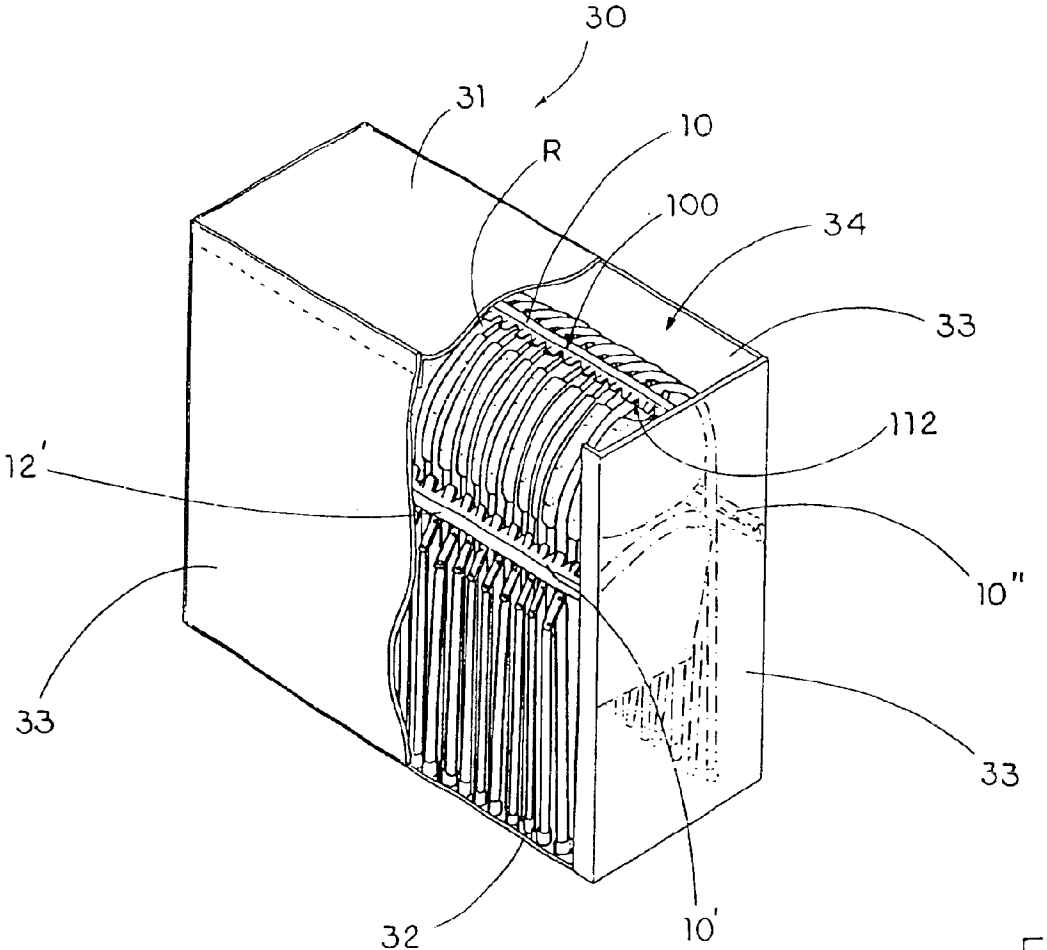
FIG. 8 is a perspective view of the side mount device incorporated with a storage box according to the above preferred embodiment of the present invention.

As shown in FIG. 8, the side mount device further comprises a storage box 30, having a rectangular shaped, comprising a plurality of boundary walls which are a top wall 31, a bottom wall 32, and four surrounding walls 33 extended edges to edges to form a storage chamber 34 within the top wall 31, the bottom wall 32, and the surrounding walls 33 for receiving the foldable furniture in an overlappedly line-up manner, wherein the common line-edge 100 of the mold strip 10 is attached to the top wall 31 in such a manner that when the foldable furniture are stored in the storage chamber 34, the top portions of the foldable furniture are locked by the mold strip 10 by sliding the side rim portions R of the foldable furniture to the mounting slots 112 respectively. In other words, the manufacturers are able to securely pack the foldable furniture into the storage box 30 by adding the mold strip 10 therein, so as to prevent any unwanted movement of the folding furniture during shipping and handling. Therefore, the foldable furniture can be easily assembled while the foldable furniture are well packed.

Preferably, a secondary mold strip 10' is attached on one of the surrounding walls 33 by attaching the second reinforcing panel 12' thereto, in such a manner that side portions of the foldable furniture are substantially retained in the storage box 30. Of course, a third mold strip 10" can be attached on another opposed surrounding wall 33 to further lock up another side portions of the foldable furniture within the storage chamber 34. It is worth mentioning that after the storage box 30 is shipped to a designated place, such as a retailer, the employee is able to open up one of the corresponding surrounding walls 33 to unlock one side portion of each foldable furniture for displaying purpose. Since the foldable furniture are still locked up by another two mold strips 10, 10', the foldable furniture will not be collapsed. Since the foldable furniture are overlappedly packed with the safety gap therebetween, the customer is able to pick the desired foldable furniture in the storage box 30 without interfering with the rest of the foldable furniture.

Figure 9:
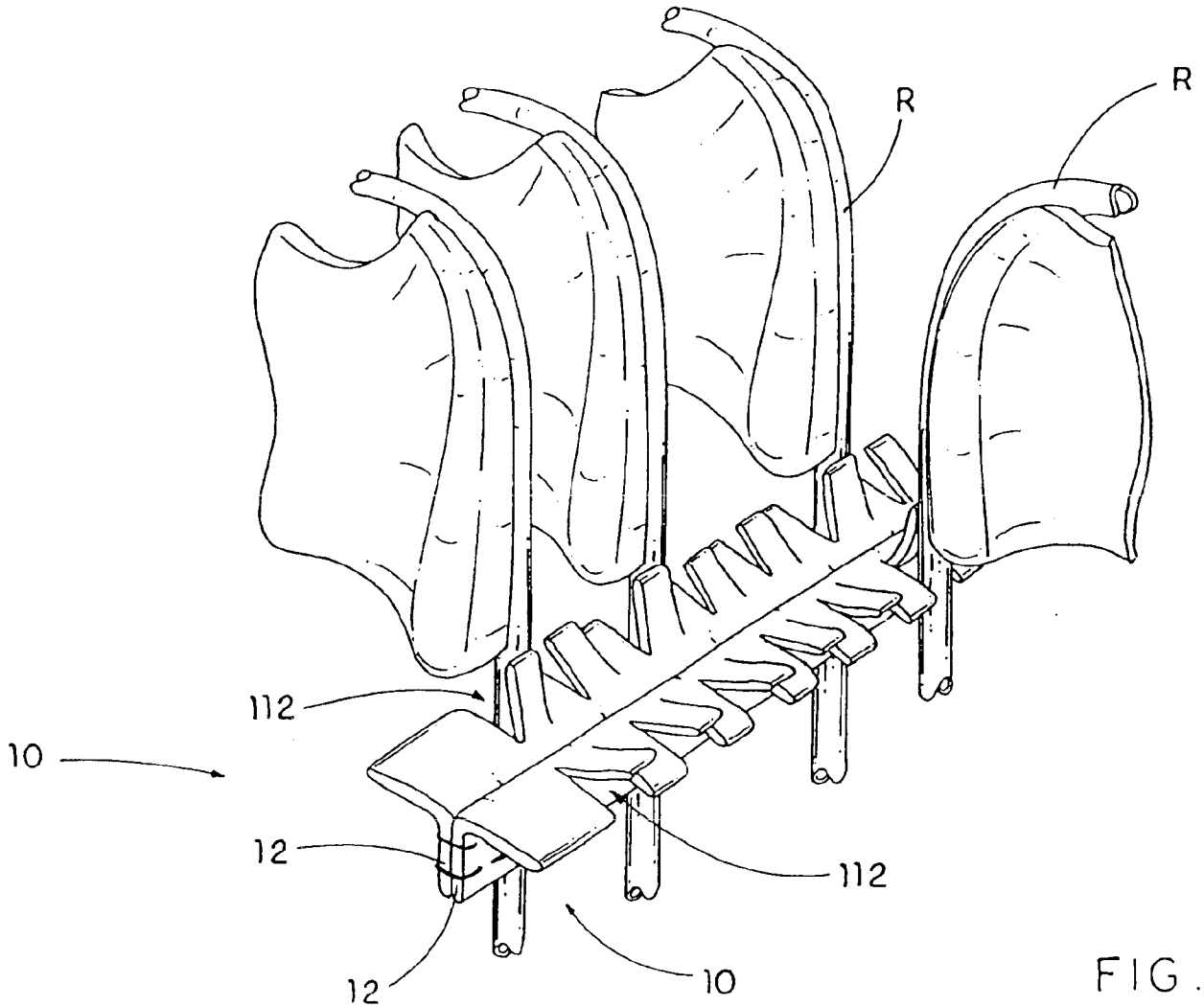
FIG. 9 is a perspective view of the side mount device incorporated with the storage box according to the above preferred embodiment of the present invention, illustrating the side mount device substantially holding two rows of foldable furniture.

In order to further enhance the storage space of the storage box 30, two mold strips 10 are adapted to be attached with each other at the second reinforcing panels 12 thereof, in such a manner that two rows of the mounting slots 112 are opposedly extended to hold the foldable furniture, as shown in FIG. 9. In other words, two rows of overlapped foldable furniture are adapted to be packed in the storage box 30 via the mold strips 10. Therefore, the manufacturer is able to use the mold strip 10 to maximize the storage chamber 34 of the storage box 30 to carry the foldable furniture without messing up the package of the foldable furniture, so as to reduce the shipping and handling costs of the foldable furniture. It is worth mentioning that the alternative modes of the mold strips 10A, 10B, 10C can be incorporated with the storage box 30 in order to enhance the secure mounting feature of the side mount device for retaining the foldable furniture in the storage chamber 34.

In view of above, the side mount device is capable of enhancing the package and display of the foldable furniture. Since the structure of the mold strip 10 is simple and can be manufactured in a very low cost, the package cost of the foldable furniture will not be increased. In addition, the mold strip 10 can protect the foldable furniture from being cracked or scratched during the shipment thereof, so as to substantially reduce the risk of damaging of the foldable furniture during transportation.

What is claimed is:

1. A side mount device for mounting on multiple foldable furniture each having a side rim portion, comprising:

a storage box, having a rectangular shaped, comprising a top wall, a bottom wall, and four surrounding walls extended edges to edges to form a storage chamber within said top wall, said bottom wall, and said surrounding walls for receiving said foldable furniture in an overlappedly line-up manner;

at least an elongated mold strip comprising a first reinforcing panel and a second reinforcing panel longitudinally extended from said first reinforcing panel along a common line-edge to define a longitudinal mounting channel therebetween, wherein said second reinforcing panel is longitudinally attached on said top wall of said storage box;

said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively so as to securely retain said foldable furniture in said storage chamber.

2. The side mount device, as recited in claim 1, wherein said mold strip further comprises a plurality of space dividers transversely extended from said first reinforcing panel between each two said mounting slots for creating a safety gap between said each two foldable furniture when said foldable furniture are slid to said mounting slots respectively.

3. The side mount device, as recited in claim 2, wherein said first reinforcing panel is made of elastic material to form each of said retaining arms as a resilient arm for applying an urging pressure on said respective side rim portion of foldable furniture when said mold strip is mounted on said foldable furniture.

4. The side mount device, as recited in claim 3, wherein said second reinforcing panel, which is constructed to be identical to said first reinforcing panel, has a plurality of mounting slots, reinforcing arms and space dividers respectively aligning with said mounting slots, said reinforcing arms and said space dividers of said first reinforcing panel, thereby, when said mold strip is mounted on said furniture, said side rim portion of said foldable furniture is slidably received in said mounting channel through said two corresponding mounting slots of said first and second reinforcing panels respectively, and said retaining arms of said first and second reinforcing panels are substantially biased against said side rim portion of said foldable furniture.

5. The side mount device, as recited in claim 3, wherein said mold strip, having a L-shaped cross sectional, defines said common line-edge where said first and second longitudinally and integrally meet with each other.

6. The side mount device, as recited in claim 3, wherein said mold strip has an arc-shaped cross section, wherein said first and second reinforcing panels are constructed to have an arc-shape and integrally extended together to provide said mounting channel having a curved top surface.

7. The side mount device, as recited in claim 3, wherein each of said molding slots has a width gradually reducing from said guider edge towards said common line-edge for fittedly receiving said side rim portion of said foldable furniture.

8. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween;

said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively, wherein said mold strip further comprises a plurality of space dividers transversely extended from said first reinforcing panel between each two said mounting slots for creating a safety gap between said each two foldable furniture when said foldable furniture are slid to said mounting slots respectively, wherein said second reinforcing panel, which is constructed to be identical to said first reinforcing panel, has a plurality of mounting slots, reinforcing arms and space dividers respectively aligning with said mounting slots, said reinforcing arms and said space dividers of said first reinforcing panel, thereby, when said mold strip is mounted on said furniture, said side rim portion of said foldable furniture is slidably received in said mounting channel through said two corresponding mounting slots of said first and second reinforcing panels respectively, and said retaining arms of said first and second reinforcing panels are substantially biased against said side rim portion of said foldable furniture.

9. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween;

said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively, wherein said mold strip further comprises a plurality of space dividers transversely extended from said first reinforcing panel between each two said mounting slots for creating a safety gap between said each two foldable furniture when said foldable furniture are slid to said mounting slots respectively, wherein said second reinforcing panel, which is constructed to be identical to said first reinforcing panel, has a plurality of mounting slots, reinforcing arms and space dividers respectively aligning with said mounting slots, said reinforcing arms and said space dividers of said first reinforcing panel, thereby, when said mold strip is mounted on said furniture, said side rim portion of said foldable furniture is slidably received in said mounting channel through said two corresponding mounting slots of said first and second reinforcing panels respectively, and said retaining arms of said first and second reinforcing panels are substantially biased against said side rim portion of said foldable furniture, wherein said mold strip, having a L-shaped cross sectional, defines said common line-edge where said first and second longitudinally and integrally meet with each other, wherein said mold strip is made by providing a plurality of cuts spacedly and transversely on said first reinforcing panel extended from said longitudinal guider edge to form a plurality of folding lips each defining between two cuts, wherein each of said retaining arms is formed by outwardly folding one of said folding lips so as to form said mounting slot and each of said space dividers is formed by unfolding one of said folding lips.

10. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween;

said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively, wherein said mold strip further comprises a plurality of space dividers transversely extended from said first reinforcing panel between each two said mounting slots for creating a safety gap between said each two foldable furniture when said foldable furniture are slid to said mounting slots respectively, wherein said second reinforcing panel, which is constructed to be identical to said first reinforcing panel, has a plurality of mounting slots, reinforcing arms and space dividers respectively aligning with said mounting slots, said reinforcing arms and said space dividers of said first reinforcing panel, thereby, when said mold strip is mounted on said furniture, said side rim portion of said foldable furniture is slidably received in said mounting channel through said two corresponding mounting slots of said first and second reinforcing panels respectively, and said retaining arms of said first and second reinforcing panels are substantially biased against said side rim portion of said foldable furniture, wherein said mold strip, having a L-shaped cross sectional, defines said common line-edge where said first and second longitudinally and integrally meet with each other, wherein said mold strip is made by providing a plurality of cuts spacedly and transversely on said first reinforcing panel extended from said longitudinal guider edge to form a plurality of folding lips each defining between two cuts, wherein each of said retaining arms is formed by outwardly folding one of said folding lips so as to form said mounting slot and each of said space dividers is formed by unfolding one of said folding lips, wherein said first reinforcing panel is made of elastic material to form each of said retaining arms as a resilient arm for applying an urging pressure on said respective side rim portion of foldable furniture when said mold strip is mounted on said foldable furniture.

11. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween, said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively; and a supporting frame which comprises a base frame and two side standing frames mounted at two sides of said base frame respectively to form a storage compartment between said side standing frames and said base frame for receiving said foldable furniture in an overlappedly line-up manner, wherein two end portions of said mold strip are mounted to two top portions of said side standing frames respectively for securely locking said side rim portions of said foldable furniture so as to securely retain said foldable furniture in said storage compartment.

12. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween, said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively, wherein said mold strip further comprises a plurality of space dividers transversely extended from said first reinforcing panel between each two said mounting slots for creating a safety gap between said each two foldable furniture when said foldable furniture are slid to said mounting slots respectively; and a supporting frame which comprises a base frame and two side standing frames mounted at two sides of said base frame respectively to form a storage compartment between said side standing frames and said base frame for receiving said foldable furniture in an overlappedly line-up manner, wherein two end portions of said mold strip are mounted to two top portions of said side standing frames respectively for securely locking said side rim portions of said foldable furniture so as to securely retain said foldable furniture in said storage compartment.

13. A side mount device for mounting on multiple foldable furniture each having a side rim portion, comprising:

at least an elongated mold strip comprising a first reinforcing panel and a second reinforcing panel longitudinally extended from said first reinforcing panel along a common line-edge to define a longitudinal mounting channel therebetween, said first reinforcing panel having a longitudinal guider edge, a plurality of mounting slots spacedly and transversally extended from said longitudinal guider edge towards said common line-edge for slidably receiving said side rim portions of said foldable furniture into said mounting channel through said mounting slots respectively while said second reinforcing panel retains said side rim portions of said foldable furniture within said mounting channel so as to spacedly hold said foldable furniture in position, and a plurality of retaining arms which are extended from upper ends of said mounting slots respectively and arranged for pressing on said side rim portions of said foldable furniture when said side rim portions of said foldable furniture are slid through said mounting slots respectively, wherein said mold strip further comprises a plurality of space dividers transversely extended from said first reinforcing panel between each two said mounting slots for creating a safety gap between said each two foldable furniture when said foldable furniture are slid to said mounting slots respectively, wherein said mold strip, having a L-shaped cross sectional, defines said common line-edge where said first and second longitudinally and integrally meet with each other, wherein said mold strip is made by providing a plurality of cuts spacedly and transversely on said first reinforcing panel extended from said longitudinal guider edge to form a plurality of folding lips each defining between two cuts, wherein each of said retaining arms is formed by outwardly folding one of said folding lips so as to form said mounting slot and each of said space dividers is formed by unfolding one of said folding lips, wherein said first reinforcing panel is made of elastic material to form each of said retaining arms as a resilient arm for applying an urging pressure on said respective side rim portion of foldable furniture when said mold strip is mounted on said foldable furniture; and a supporting frame which comprises a base frame and two side standing frames mounted at two sides of said base frame respectively to form a storage compartment between said side standing frames and said base frame for receiving said foldable furniture in an overlappedly line-up manner, wherein two end portions of said mold strip are mounted to two top portions of said side standing frames respectively for securely locking said side rim portions of said foldable furniture so as to securely retain said foldable furniture in said storage compartment.

* * * * *